United States Patent [19]

Hartford et al.

[11] 4,252,097

[45] Feb. 24, 1981

[54] VISCOSITY COMPENSATED FUEL INJECTION SYSTEM

[75] Inventors: Thomas W. Hartford, Livonia; Alvin D. Toelle, Fenton, both of Mich.

[73] Assignee: The Bendix Corporation, Southfield, Mich.

[21] Appl. No.: 918,974

[22] Filed: Jun. 26, 1978

[51] Int. Cl.[3] ..... F02D 1/04; F02D 1/06

[52] U.S. Cl. ..... 123/381; 73/32 R; 73/438

[58] Field of Search ..... 123/140 VS, 140 ML; 73/32 R, 438, 447

[56] References Cited

U.S. PATENT DOCUMENTS 3,483,855 12/1969 Thoma ..... 123/140 VS

FOREIGN PATENT DOCUMENTS 882148 5/1942 France ..... 123/140 VS 898391 6/1962 United Kingdom ..... 123/140 VS

*Primary Examiner*—Ronald B. Cox

*Attorney, Agent, or Firm*—Gaylord P. Haas, Jr.; Russel C. Wells

[57] ABSTRACT

An apparatus and method for supplying a predetermined volume of liquid fuel (20) to a cylinder of a diesel engine (10) is provided. A storage tank (22) stores a column of the liquid fuel (20) in a storage area (24). A position sensor (36) transmits an analog signal proportional to the height of the fuel (20) in the tank (22). A pressure transducer (32) disposed at the bottom of the storage area (24) transmits an analog signal corresponding to the static fluid pressure at the bottom of the storage area (24). A temperature transducer (56) disposed along a fuel rail (16) transmits an analog temperature signal to an electronic fuel injection computer (14). The computer (14) converts the analog height signal, the analog temperature signal and the analog pressure signal into digital values and mathematically divides the resulting digital values of height and pressure to obtain a digital value for the fuel density. A programmed ROM (72) of the computer (14) produces an output binary signal representative of a predetermined viscosity based on the instantaneous values of the temperature and the density of the fuel (20) over a range of values of the density and the temperature. The ROM (72) generates a three-dimensional surface representing values of viscosity based upon the temperature and the density. The output binary signal of the ROM (72) is used by the computer (14) through a diesel output control (11) to control a metering solenoid (13) of a fuel injector (12) which injects fuel into a cylinder of the engine (10).

4 Claims, 2 Drawing Figures

VISCOSITY COMPENSATED FUEL INJECTION SYSTEM

TECHNICAL FIELD

Figure 1:
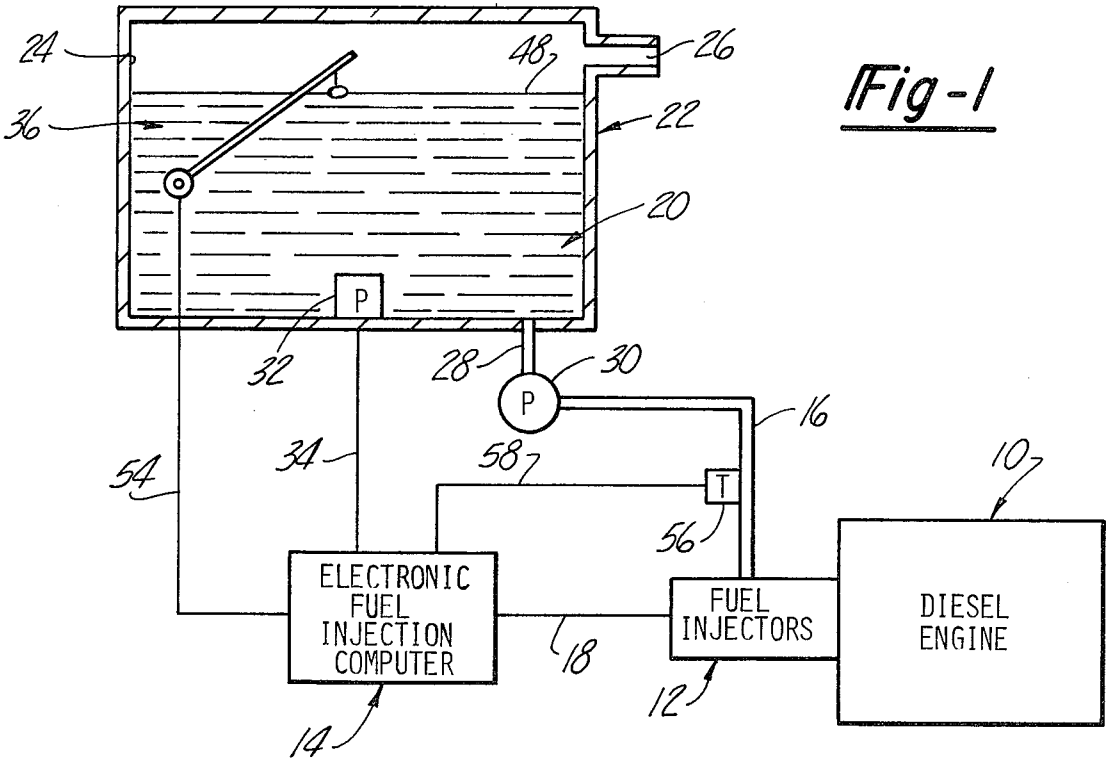

This invention relates to a method and apparatus for supplying liquid fuel to a cylinder of an internal combustion engine and in particular to supplying the liquid fuel in predetermined amounts.

BACKGROUND ART

In order to control emissions from an internal combustion engine and its efficiency, it is necessary to control the fuel delivered into the cylinder of the internal combustion engine with a high degree of accuracy. For example, if too much fuel is supplied into the cylinder, the fuel is not burned properly and is wasted. As a result, the efficiency of the engine suffers. If too little fuel is supplied into the cylinder, the power of the engine is not fully utilized. If the amount of fuel supplied into the cylinder of the engine is held within close tolerances (for example, within one (1) percent of a desired value) the efficiency of the engine is increased and the amount of harmful emissions is reduced.

In fuel supply means wherein the fuel is injected into the cylinder of an internal combustion engine, in metered or measured amounts, the viscosity of the liquid fuel determines the time required to meter a predetermined desired volume of the liquid fuel. In other words, the time required for a predetermined volume to flow varies with viscosity. In the case of a liquid flowing through a long tube of small diameter, the volume V of liquid which escapes in a time t is given by the equation:

$$V = \frac{\pi p r^4 t}{8\, ln}$$

where p is the pressure between the two ends of the tube; r its radius; l its length and n the viscosity (Law of Poiseuille). An electronic fuel injector which injects fuel into a cylinder of an internal combustion engine is controlled by a metering solenoid which controls the amount of liquid fuel flowing through a metering valve. The longer the metering solenoid is actuated, the greater the amount of fuel which flows through the metering valve of the fuel injector. Given a fixed period of time, a smaller amount of fuel having a high viscosity will flow through the metering valve than the amount of fuel having a lower viscosity.

The viscosity of a liquid fuel is given by the equation:

$$n = \frac{\pi d g r^4 t}{8Q(1+\lambda)}\left(h - \frac{mv^2}{g}\right),$$

where d is the density in g/cm$^2$; r, the radius, l the length of the tube in cm; Q the volume in cm$^3$ discharged in t sec; λ a correction to the length of the tube; h, the average head in cm; in the expression mv$^2$/g, m is the coefficient of the kinetic energy correction; g is the acceleration due to gravity in cm/sec$^2$, and v is the mean velocity in cm/sec. The volume of fuel delivered in a given time is a function of viscosity as shown by the first equation. In order to deliver a given volume, regardless of variation in viscosity, the time period of flow of the metered charge may be varied as a function of viscosity. The viscosity of a liquid is related to the mass or BTU content of the fuel delivered since the viscosity is a function of the fuel density as shown by the second equation.

If the actuation time of the metering solenoid is to be controlled to provide a predetermined or desired metered amount or volume of liquid fuel to the cylinder of an internal combustion engine, it is necessary to know the viscosity of the liquid fuel. This is particularly true in the case of a diesel engine which can operate on liquid fuel of varying viscosity, for example, No. 1 or No. 2 diesel fuel.

Prior patents disclose ways of regulating the volume or rate of flow of liquid fuel. For example, the U.S. Pat. No. 2,996,053 to Evans discloses a fuel control system in which the maximum rate of delivery of a fuel pump is regulated according to the density of the fuel. Fuel density is determined by the position of a float in a fuel chamber. Alternatively, fuel density is determined by the position of a spring mounted cup which holds a given quantity of fuel. A rod connected with the float or cup positions a wedge which acts as an abutment for a fuel regulation rod to control the quantity of fuel delivered by the pump in accordance with the density.

The U.S. Pat. No. 3,307,391 to Parker discloses a fuel control system in which the viscosity of the fuel is continuously measured. In accordance with the viscosity measurement, the maximum volumetric rate at which the fuel is being used is limited. The viscosity is measured by causing the fuel to flow at a constant rate into a chamber and allowing it to escape through an orifice so that the outflow is inversely proportional to the viscosity. The pressure within the chamber is taken as an indication of viscosity and a fuel control lever is positioned according to the measured value of pressure.

The French Patent to Angeli et al 882,148, discloses a fuel injection system in which the volume of fuel injected is regulated in accordance with the temperature of the fuel. A temperature sensitive bulb controls a cam position which, in turn, alters the effective length of a fuel control rod of the injector pump.

The U.S. Pat. No. 3,483,855 to Thoma discloses an arrangement in which the volume of fuel injected is regulated in accordance with the vapor pressure of the fuel.

DISCLOSURE OF THE INVENTION

An object of the present invention is to provide an apparatus for supplying a predetermined volume of liquid fuel from a fuel tank to a cylinder of an internal combustion engine regardless of variations in the viscosity of the fuel.

Another object of this invention is to determine a fuel flow correction factor proportional to the viscosity of the liquid fuel from density and the temperature of the fuel and the value of the factor is used to correct the metering time required to obtain the predetermined volume.

In particular, the value of the correction factor is used to control the duration of a control signal which actuates a fuel injector.

Another object of this invention is to determine the density of the fuel from the height of the stored fuel above a predetermined reference level and the static fluid pressure at the preference level by using simple inexpensive sensors, wherein the viscosity is determined from the density and the temperature of the liquid fuel.

A further object of the invention is to use an electronic computer to interpolate stored values of viscosity of a mathematical surface having independent variables of density and temperature to obtain a value of the viscosity, wherein an adjusting means controls the duration of the control signal in accordance with the value of viscosity.

Yet another object of the present invention is to provide an apparatus for supplying a predetermined volume of liquid fuel from a fuel tank to the cylinder of an internal combustion engine wherein an electric fuel injector is controlled by an electronic computer, the electronic computer providing a control signal corresponding to the density of the fuel and the temperature of the fuel to enable the electric fuel injector to inject the predetermined volume of liquid fuel into the cylinder.

Another object of this invention is to provide a method for supplying a predetermined volume of liquid fuel to a cylinder of an internal combustion engine by determining the density of the liquid fuel, sensing the temperature of the liquid fuel, correlating the density and the temperature of the liquid fuel in a predetermined fashion to obtain the viscosity of the fuel, and supplying the fuel in predetermined volumes in accordance with the value of the viscosity.

In carrying out the above objects and other objects of this invention a preferred embodiment of the invention comprises a fuel supply means and a fuel injector adapted to inject successive fuel charges into a combustion chamber, and a computing means for determining the value of a time interval required to produce a charge of fuel through a passage. The computing means includes a signal processing means for processing signals, and a control means for producing a control signal having a duration corresponding to the time interval and connected with the injector. A viscosity determining means is connected to the signal processing means and is adapted to be connected with the fuel supply means for coaction with the liquid fuel for developing in cooperation with the signal processing means a signal corresponding to the viscosity of the liquid fuel. The signal processing means further includes adjusting means for adjusting the value of the time interval in accordance with the signal. The adjusting means is adapted to be connected to the control means for providing an adjusted control signal in accordance with the value of viscosity.

In further carrying out the above objects and other objects of this invention a preferred embodiment of the invention comprises a fuel supply means and a fuel injector adapted to inject successive fuel charges into a combustion chamber, and a computing means for determining the value of a time interval required to produce a charge of fuel through a passage. The computing means includes a control means for producing a control signal having a duration corresponding to the time interval and connected with the injector. A means is adapted to be connected with the fuel supply means for coaction with the liquid fuel and is adapted to be connected to the control means for providing an adjusted control signal in accordance with the value of viscosity.

Further carrying out the above objects and other objects of this invention a preferred embodiment of the invention of metering successive liquid fuel charges to the combustion chamber of an engine includes the step of determining the viscosity of the liquid fuel. Each charge of fuel is produced by the flow of liquid fuel through a passage for a controlled time interval. The preferred embodiment further includes the step of adjusting the time interval of fluid flow for a charge in accordance with the value of viscosity of the liquid fuel.

The objects, features and advantages of the present invention are readily apparent from the following detailed description of the best mode taken in connection with the accompanying drawings.

BEST DESCRIPTION OF THE DRAWINGS

Figure 2:
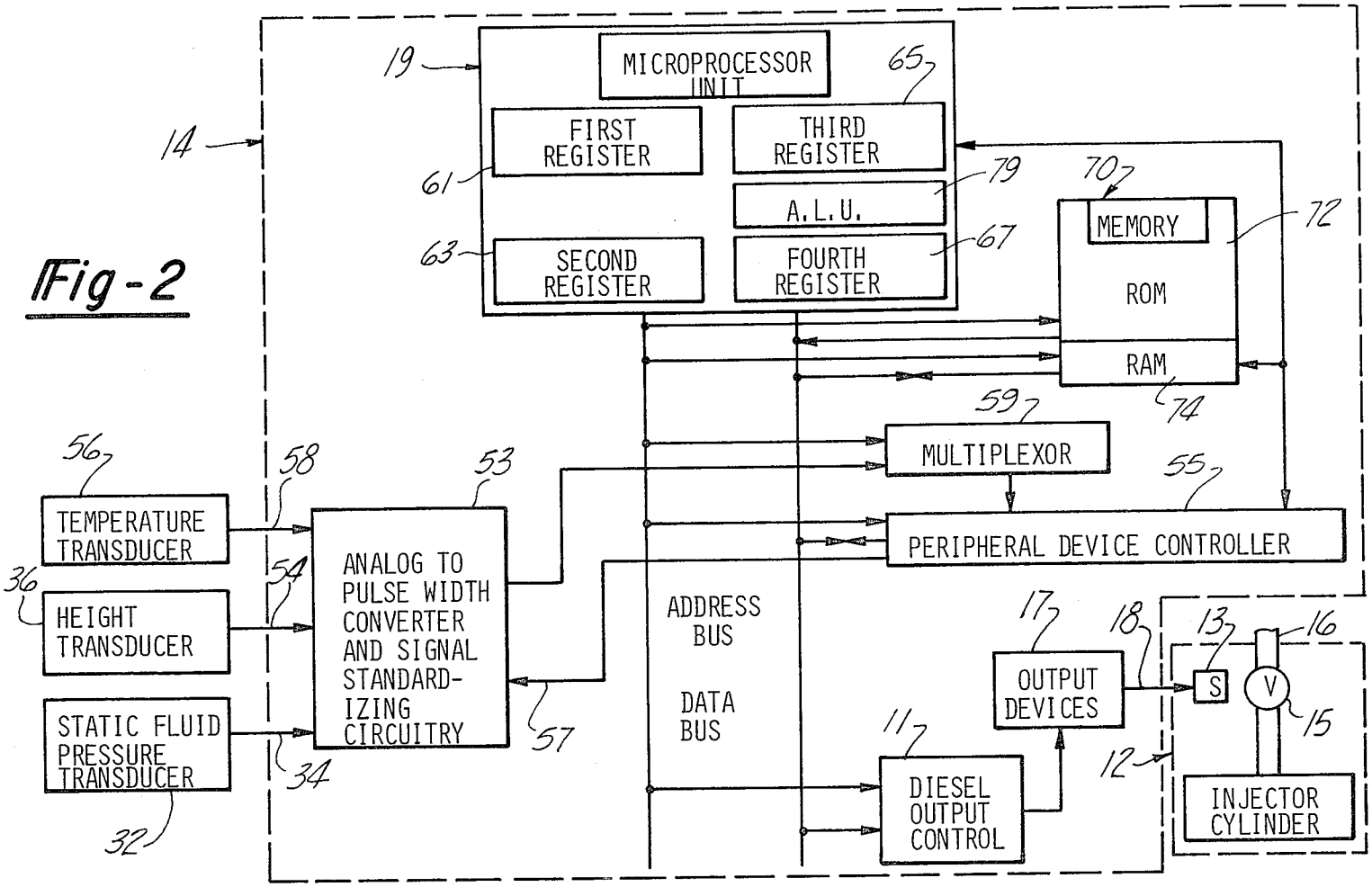

FIG. 1 is a schematic drawing of the supply apparatus constructed according to this invention; and FIG. 2 is a block diagram showing in schematic form the details of the eletronic fuel injection computer and the electric fuel injector.

BEST MODE FOR CARRYING OUT THE INVENTION

Referring now to the drawings, a diesel engine is generally indicated at 10 in FIG. 1. The teachings of the subject application, however, are applicable also to other types of combustion engines such as spark ignition or turbine engines. In the preferred embodiment, liquid fuel is injected into the cylinders of the diesel engine 10 by means of electric fuel injectors (one for each cylinder) one of which is generally indicated at 12. The fuel injectors are controlled by a computing means or an electronic fuel injection computer generally indicated at 14 and more particularly by a control means or a diesel output control 11 in combination with output drivers 17 as shown in FIG. 2. The electronic fuel injection computer 14 controls the volume of fuel injected into the cylinders of the diesel engine 10 as described in U.S. patent application No. 881,321 entitled Microprocessor-Based Electronic Engine Control System, filed Sept. 27, 1977 having a common assignee as the subject application and which application is hereby incorporated by reference.

Each of the electric fuel injectors 12 includes a metering solenoid 13 which operates or controls a metering valve 15 of the injector 12 to allow fuel to flow therethrough. The fuel flows from a pressurized fuel rail 16 through the metering valve 15 and into an injector cylinder of the fuel injector 12 under consideration as shown in FIG. 2. The metering valve 15 is thereafter closed to allow the fuel injector 12 to inject the metered fuel into a cylinder of the diesel engine 10. The length of time that the metering solenoid 13 is actuated to allow the fuel to flow through the metering valve 15 is determined by an electric control signal generated by the diesel output control 11. The control signal comprises an electrical pulse having a width or duration which is determined for each injection by the computer 14 in accordance with selected engine operating parameters as described in the above-noted application. The electrical control signals from the diesel output control 11 are amplified by the output drivers 17 which enable the output control signals to operate the metering solenoids. Accordingly, the metering solenoid 13 is actuated by the pulse for a period of time determined by the width of the amplified pulse. The diesel output control 11 sequentially generates electrical pulses which are first amplified and then transmitted over the wires 18, one wire leading to the metering solenoid 13 of each fuel injector 12.

The output control 11 of the preferred embodiment of the invention includes a pair of programmable counters and an R-S flip-flop. The programmable counters are programmed by a signal processing means or a microprocessor unit 19 of the computer 14 preferably a Motorola MC 6800 processor chip. The first counter is electrically connected to the set input of the R-S flip-flop and the second counter is electrically connected to the reset input of the flip-flop. The first counter sets the flip-flop to a "high" value or logical one for a period of time determined by the programmed contents of the first counter. Similarly the second counter resets the flip-flop to a "low" or logical zero value for a period of time determined by the programmed contents of the second counter. The microprocessor unit 19 programs the two counters for the injection into each cylinder in accordance with selected engine operating parameters and the viscosity of the fuel as will be described in greater detail hereinafter.

The microprocessor unit 19 is electrically connected to the output control 11 by a 16-bit parallel address bus and an 8-bit parallel bi-directional data bus as shown in FIG. 2.

As shown in FIG. 1, the fuel, generally indicated at 20, is stored in a storage means or a fuel tank generally indicated at 22. The fuel tank 22 stores a column of the liquid fuel 20 at a storage area 24. The storage tank 22 has an inlet passage 26 for adding the fuel 20 to the fuel tank 22.

The fuel 20 is drawn from the tank 22 through a fuel drain tube 28 by a fuel pump 30 which pressurizes the fuel distribution rail 16 which provides fuel 20 to the fuel injectors 12.

The viscosity of the fuel 20 is determined by the electronic fuel injection computer 14 from the fuel density and the temperature of the fuel, as will be described in greater detail hereinafter. The density of the fuel is given by the equation:

$$d = \Delta P / g \Delta Y$$

where d is the density; $\Delta P$ is the change in static fluid pressure from the free surface of the liquid fuel to the reference height; g is the acceleration due to gravity; and $\Delta Y$ is the height of the liquid column above the reference height which in this case is the bottom of the fuel tank 22. It should be noted that the value of the static fluid pressure at the free surface is assumed to be a constant and therefore need not be determined to obtain $\Delta P$. It would be a simple matter to provide a second pressure transducer to calculate $\Delta P$ to a greater degree of accuracy.

The fuel density is obtained by using simple, inexpensive sensors such as a static fluid pressure sensor or transducer 32 which can be a conventional type, for sensing the static fuel pressure at the bottom of the fuel tank 22. The pressure transducer 32 which is disposed at the bottom of the fuel tank 22, transmits an analog electric signal over wires 34 to the electronic fuel injection computer 14. The analog electric signal represents the static fluid pressure exerted on the pressure transducer 32 at the bottom of the tank 22 by the fuel 20.

The height of the liquid colum of fuel 20 above the pressure transducer 32 is sensed by a conventional position or height sensor or transducer 36. The position sensor 36 transmits an analog signal proportional to the height of the fuel 20 in the fuel tank 22 to the electronic fuel injection computer 14.

The electronic fuel injection computer 14 determines the viscosity of the liquid fuel 20 from the density and the temperature of the fuel as previously noted. The temperature is obtained by a transducer means or a temperature sensor or transducer 56 which is disposed along the fuel rail 16 to sense the temperature of the fuel 20 in the rail 16. The temperature transducer 56 comprises an ordinary or conventional thermister which transmits an analog electrical signal along a wire 58 to the electronic fuel injection computer 14.

The analog electric signals representing the fuel level or height, the fuel temperature and the fluid static pressure are converted to digital binary words by the computer 14 to be in a form usable by the microprocessor unit 19. The computer 14 includes an analog-to-pulse width converter and signal standardizing circuitry 53. The converter and standardizing circuitry 53 converts a chosen analog input signal to a pulse having a width proportional to the sensed physical variable and standardizes the pulse height and width to be compatible with the remainder of the circuit.

Before each cylinder cycle a peripheral device controller 55 under control of the microprocessor unit 19 asynchronously selects each of the transducers' signals to be converted and standardized by outputting sensor addresses on a bus 57 to the converter and standardizing circuitry 53. A multiplexer 59, also under control of the microprocessor unit 19, asynchronously selects the pulse outputs by the circuitry 53 corresponding to the chosen sensors and outputs the chosen pulses to the controller 55. In turn, the controller 55 converts the pulse widths into binary words or numbers which are synchronously sent to the microprocessor unit 19 in synchronism with the unit's data processing rate.

The microprocessor unit 19 includes a plurality of binary counters or registers such as a first, second, third and fourth register 61, 63, 65 and 67. The binary words representing the height and the pressure of the fuel are placed in the first and second registers 61 and 63, respectively. The contents of the second register 63 is divided by the contents of the first register 61, under control of an arithmetic logic unit 79 and temporarily placed in the third register 65 whose contents represent the density of the stored fuel. In the same fashion a binary word representing fuel temperature is placed in the fourth register 67 after the above conversion and standardizing is completed under control of the microprocessor unit 19.

The electronic fuel injection computer 14 includes a memory 70 having a conventional, commercially available read-only-memory (ROM) 72. The ROM 72 is preprogrammed in a similar fashion as the ROM's shown in the above-noted application. The ROM 72 produces an output binary signal representation of a predetermined viscosity in the form of a fuel flow correction factor based on the instantaneous values of fuel density and fuel temperature at each of a plurality of respective selected points within a range of values in response to respective input address signals from the third and fourth registers 65 and 67. Over the range of values the ROM 72 represents a three-dimensional mathematical surface of viscosity. The contents of the third and fourth registers 65 and 67 and the arithmetic logic unit 79 are used in the interpolating process, the result being placed in one of the registers. A random access memory (RAM) 74 of the memory 70 stores the intermediate results of the interpolation process. The particular shape of the mathematical surface is, in general, determined by the design of the fuel injector 14.

After the interpolation process is completed the viscosity, in the form of the fuel flow correction factor represented by a binary word, is multiplied by a binary word representing a control pulse width or duration determined in accordance with selected engine operating parameters such as manifold pressure, air temperature, et cetera, as noted in the above application. The multiplication is performed by the arithmetic logic unit 79 and the result is placed in the first programmable counter of the output control 11 to set the output flip-flop for a period of time proportional to the contents of the first programmable counter thereby determining the pulse width of the adjusted control signal. As previously described, the adjusted control signal is thereafter amplified to operate a chosen metering solenoid.

While a preferred embodiment of the method and apparatus has been shown and described herein in detail, those skilled in the art will recognize various alternative designs and embodiments for practicing the present invention as defined by the following claims.

What is claimed is:

1. A control system for metering successive liquid fuel charges to the combustion chamber of an engine, said system being of the type having a fuel supply means and a fuel injector adapted to inject successive fuel charges into the engine for a controlled time interval, computing means for determining the duration of the time interval in accordance with selected engine parameters including control means for producing a control signal having a duration corresponding to the time interval and connected with the injector, said control system comprising:

viscosity determining means connected to the signal processing means and adapted to be connected with the fuel supply means for coaction with the fuel for developing, in cooperation with the computing means, a signal corresponding to the value of viscosity of the fuel;

said viscosity determining means including temperature determining means including first transducer means for producing a first signal corresponding to the temperature of said fuel;

a density determining means including first sensing means for sensing the height of the liquid fuel above a predetermined reference level within the fuel supply means;

a second sensing means for sensing the static fluid pressure at said reference level, said density determining means developing a density signal from said sensed height and said static fluid pressure; and the computing means including adjusting means for adjusting the duration of the time interval in accordance with said temperature signal and said density signal and adapted to be connected with said control means for providing an adjusted control signal in accordance with the value of viscosity.

2. The system as claimed in claim 1 wherein said computing means includes a read-only-memory programmed to produce viscosity signal defining an output binary signal representation of viscosity based upon the instantaneous values of fuel density and temperature at each of a plurality of selected points within a range of values in response to said temperature and density signals, whereby over the range of values of the density and the temperature, the read-only-memory generates a three-dimensional surface of viscosity based upon the temperature and the density.

3. A method of metering successive liquid fuel charges to the combustion chamber of an engine wherein each charge is produced by the flow of liquid fuel through a passage for a controlled time interval, the improvement comprising the steps of:

determining the viscosity of the liquid fuel including;

determining the density of the liquid fuel by sensing the height of the liquid fuel above a predetermined reference level in the fuel tank;

sensing the static fluid pressure at said reference level;

correlating the density and the temperature of the liquid fuel in a predetermined fashion to obtain the viscosity of the liquid fuel; and adjusting the time interval of fuel flow for a charge in accordance with the value of viscosity of the liquid fuel including sensing the temperature of the liquid fuel.

4. The method as claimed in claim 3 further including the step of interpolating a mathematical surface representing values of viscosity, the surface having independent variables of density and temperature, to determine the viscosity of the liquid fuel.

* * * * *